United States Patent [19]

Wang

[11] Patent Number: 5,021,015

[45] Date of Patent: Jun. 4, 1991

[54] PROPULSION MECHANISM FOR A BOAT

[76] Inventor: June-Chi Wang, No. 2-1, Alley 9, Hung En 3 Lane, Sec. 3, Hsi Tun Rd., Hsi Tun District, Taichung, Taiwan

[21] Appl. No.: 482,332

[22] Filed: Feb. 20, 1990

[51] Int. Cl.[5] ..... B63H 16/16

[52] U.S. Cl. ..... 440/13; 440/24

[58] Field of Search ..... 440/13, 14, 15, 17, 440/19, 20, 24; 416/79, 81

[56] References Cited

U.S. PATENT DOCUMENTS

| | | | |
|---|---|---|---|
| 913,624 | 2/1909 | Daniel | 416/79 |
| 3,095,850 | 7/1963 | Stolzer | 440/24 X |
| 3,139,061 | 6/1964 | Johnston | 440/24 X |

*Primary Examiner*—Sherman Basinger

[57] ABSTRACT

A propulsion mechanism for a boat includes a boat body; a bar being laterally provided on the boat body; a sliding block being provided on and slidable along the bar; a paddle being pivotally disposed on the sliding block and being submerged in water on which the boat body is floated; a restraining device being coupled to said paddle and being rotated in concert with the paddle; the restraining device limiting a rotatable range of the paddle; and two pulling rings being fixed to the sliding block. The sliding block is drawn to move laterally and reciprocally when the pulling rings are alternatively and reciprocally pulled by a user, so that the paddle moves relative to the water and so that a reactive force is produced to propel the boat body.

7 Claims, 5 Drawing Sheets

PROPULSION MECHANISM FOR A BOAT

BACKGROUND OF THE INVENTION

The present invention relates to a propulsion mechanism, and more particularly to a propulsion mechanism for a boat or the like.

Conventional boats are generally propelled by such means as propellers, oars, paddles or the like. Propellers require an electric or mechanical power system to drive them, and thus the boats equipped with propellers are not good for exercising purposes. Rowing a boat by paddles or oars requires a certain amount of training, which is time consuming and not highly entertaining.

The present invention has arisen to provide a propulsion mechanism for a boat which has a totally different configuration as compared with conventional propulsion mechanisms for boats.

SUMMARY OF THE INVENTION

The primary objective of the present invention is to provide a propulsion mechanism for a boat, which can be manually actuated to propel the boat for exercising, competitive or entertainment purposes.

In accordance with one aspect of the present invention, there is provided a propulsion mechanism for a boat which includes a boat body; a frame body being disposed on a rear end of the boat body, the frame body including a bar which is lateral to the boat body; a number of pulleys being disposed on both sides of the frame body; a sliding block being provided on and slidable along the bar; a shaft being pivotally disposed on the sliding block; a paddle being disposed on a lower end of the shaft and being submerged in water on which the boat body is floated; a restraining device being coupled to an upper end of the shaft so that the restraining device and the paddle rotate in concert, the restraining device limiting a rotatable range of the paddle; a cable being provided and surrounded the pulleys, the sliding block being fixed to a middle portion of the cable; and two pulling rings being fixed to two free ends of the cable. The sliding block is drawn to move laterally and reciprocally when the pulling rings are alternatively and reciprocally pulled by a user, so that the paddle moves relative to the water and so that a reactive force is produced to propel the boat body.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
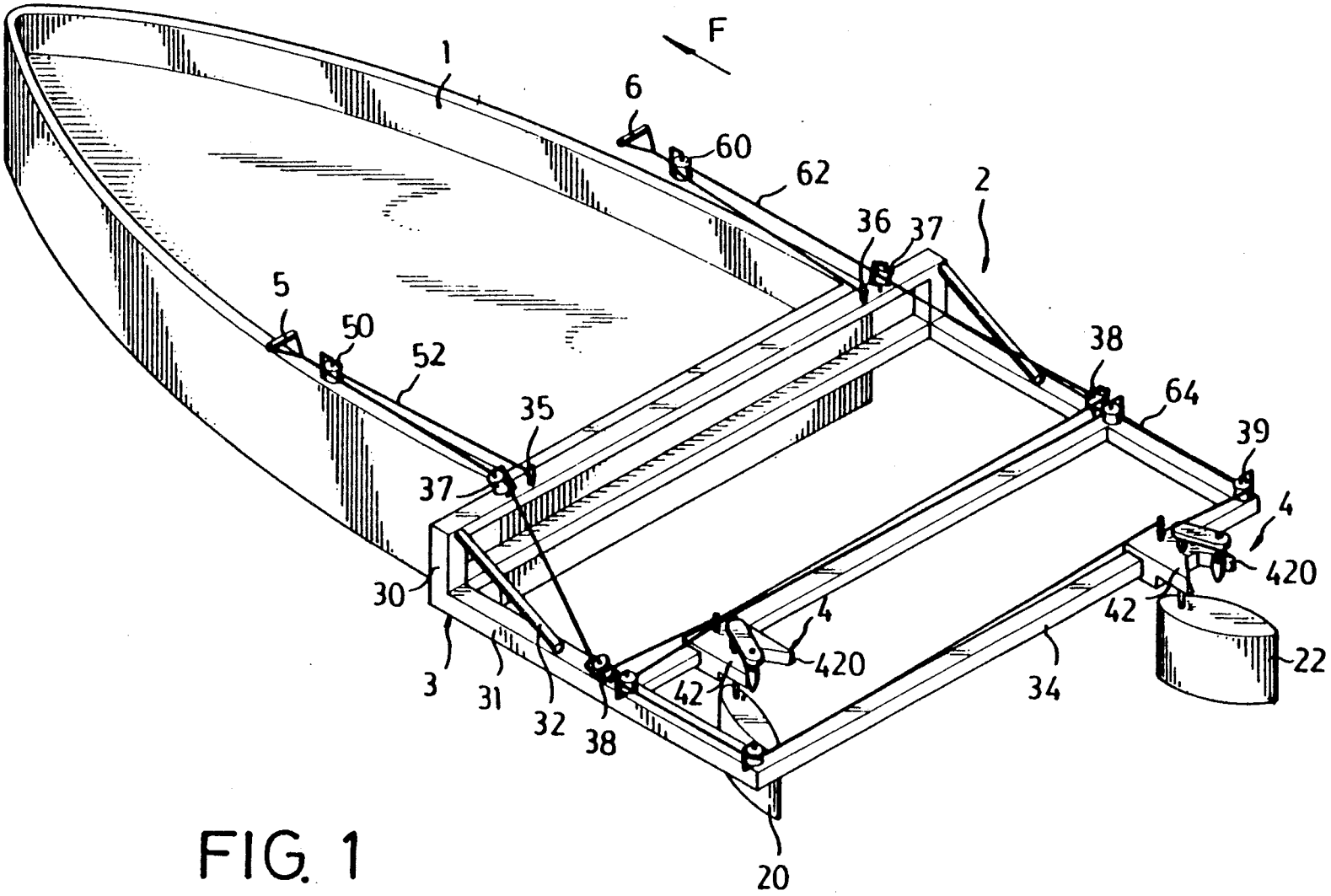
FIG. 1 is a perspective view of a propulsion mechanism for a boat in accordance with the present invention.

Referring to the drawings and initially to FIG. 1, the propulsion mechanism for a vessel, a boat or the like in accordance with the present invention is provided on a rear end of a boat body 1, in which the propulsion mechanism is generally designated by the reference numeral 2.

The propulsion mechanism 2 generally comprises a frame body 3, two restraining devices 4, two paddles 20, 22 and two pulling rings 5 and 6. The frame body 3 includes a vertical frame 30 and a horizontal frame 31. Two bracing struts are connected between the vertical frame 30 and the horizontal frame 31 for reinforcement of the frame body 3. The vertical frame 30 is fixed to the rear end of the boat body 1. The horizontal frame 31 includes two lateral and parallel bars 33, 34 which have a substantially rectangular cross section. Two pins 35, 36 are fixed on an upper end of the vertical frame 30 and are spaced apart. Two pulleys 37 are provided beside the respective pins 35, 36. Two pulleys 38 are provided on both ends of the bar 33. Four pulleys 39 are provided on the respective ends of the two bars 33, 34.

Each restraining device 4 includes a sliding block 40 having a rectangular hole 41 formed in a front end thereof for receiving the respective bars 33, 34. The sliding blocks 40 are slidable along the respective bars 33, 34. A pair of lugs 42, 420 are formed on a rear end of each sliding block 40 so that a dovetail shape is formed. A pin 43 is fixed on an upper surface of each sliding block 40 close to the front end thereof. A shaft 44 is vertically and rotatably provided on each sliding block 40 and extends beyond the upper surface and the lower surface of each sliding block 40. The shaft 41 is supported by a bearing (not shown) or the like so that the shaft 44 does not move up and down relative to the sliding block 40. One end of a lever arm 45 is fixed on an upper end of the shaft 44. The upper end of the shaft 44 is preferably rectangular and the corresponding hole in the end of the lever arm 45 is also preferably rectangular so that the lever arm 46 does not rotate relative to the shaft 44. A bolt 46 is threadedly engaged on the other end of the lever arm 45 and extends downward from the lever arm 45. A stop 47 which is substantially cone-shaped is threadedly engaged on a lower end of the bolt 46 and is substantially located between the lugs 42, 420 so that a rotational movement of the lever arm 45 and the stop 47 is limited by the lugs 42, 420.

The paddles 20, 22 are preferably identical in shape and in size and are disposed on the lower ends of the respective shafts 44. Each paddle 20, 22 is preferably symmetrical. The shaft 44 is preferably disposed on the camber line (C1, C2 of FIG. 2) of each paddle 20, 22. The distance between the shaft 44 and the leading edge of the respective paddle 20, 22 is preferably about one quarter of the camber line of the paddle. The shaft 44 separates each paddle 20, 22 into a front portion and a rear portion. The camber line of each paddle 20, 22 is parallel to the lever arm 45. The lever arms 45 and the respective paddles 20, 22 are rotated in concert. The shaft 44 is long enough such that the paddles 20, 22 are lower than the boat body 1 and are submerged in water where the body 1 is buoyant.

A pulley 50, 60 is provided on a rear end of each pulling ring 5, 6. One end of a cable 52 is fixed to the pin 35 and the other end thereof is fixed to the pin 43. The cable 52 passes through and slidably contacts the pulley 50 of the pulling ring 5 and the respective pulleys 37, 38. One end of a cable 62 is fixed to the pin 36 and the other end thereof is fixed to the pin 43. The cable 62 passes through and slidably contacts the pulley 60 of the pulling ring 6 and the respective pulleys 37, 38. A cable 64 has two ends fixed to the pin 43 and surrounds the four pulleys 39 so as to form an endless loop. The pin 43 of the restraining device 4 which is slidable along the bar 34 is fixed on a middle portion of the cable 64 so that the two restraining devices 4 are interconnected by the cable 64 and move in concert.

Figure 2:
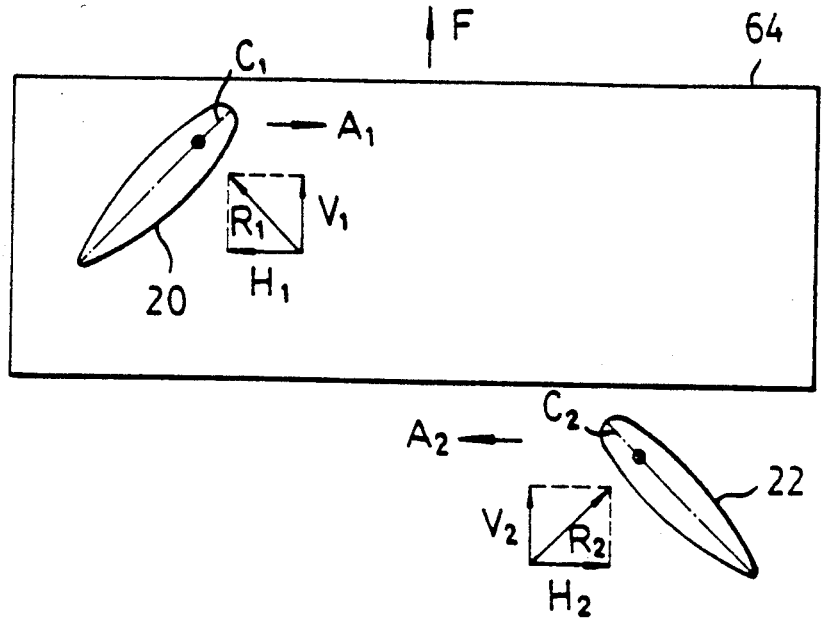
FIG. 2 is a schematic view illustrating reactive forces acting on the paddles.

Considering now the operation of the propulsion mechanism shown in FIG. 1, the user expends energy by alternatively and reciprocally pulling the pulling rings 5, 6. This movement applies force to draw the pins 43 and the restraining devices 4 so that the restraining devices 4 slide along the respective bars 33, 34. Referring next to FIGS. 1 and 2, when the user pulls the pulling ring 6, the paddle 20 is forced to move along the direction of the arrow A1, and the paddle 22 is forced to move along the direction of the arrow A2. The rear portion of each paddle 20, 22 has a larger surface area than that of the front portion so that the rear portion is subjected to larger hydraulic force. Therefore, when the paddles 20, 22 initially move from the positions as shown in FIG. 2 along the respective arrows A1, A2, the paddle 20 is biased by the hydraulic force to rotate clockwise about the shaft 44 until the stop 47 contacts the lug 42 and the paddle 22 is biased to rotate counterclockwise until the stop 47 contacts the lug 420 (as shown in FIGS. 1 and 2). It is to be noted that one end of each cable 52, 62 is fixed to the respective pins 35, 36. When each pulling ring 5, 6 is pulled a distance, the pins 43 are forced to move twice the distance so that the movable distance of the restraining device 4 is enlarged. Alternatively, if the ends of the cables 52, 62 are directly fixed to the pulling rings 5, 6, the pulling rings 5, 6 and the pins 43 move in concert.

Figure 3:
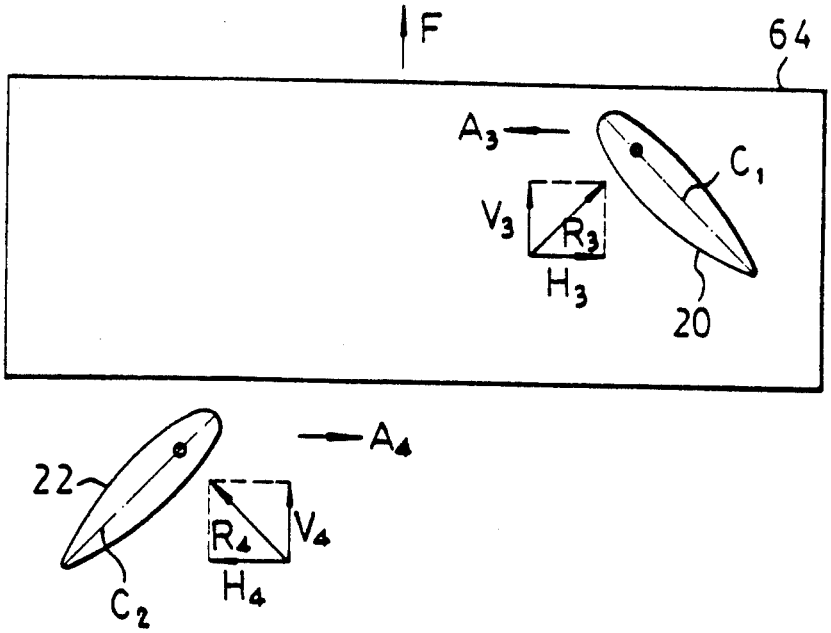
FIG. 3 is a schematic view similar to FIG. 2, illustrating reactive forces acting on the paddles.

Referring again to FIG. 2, when the paddles 20, 22 move along the directions of the respective arrows A1, A2, a reactive force R1, R2 which is perpendicular to the camber line C1, C2 of the respective paddles 20, 22 is produced to act on the pivot axis of the respective paddles 20, 22. The horizontal components H1, H2 thereof are balanced, The vertical components V1, V2 thereof propel the boat body 1 forwards. The paddles 20, 22 move to the positions substantially as shown in FIG. 3.

Similarly, when the pulling ring 5 is pulled, the paddles 20, 22 are biased by the hydraulic force to rotate counterclockwise and clockwise until the stops 47 contact the respective lugs 420, 42. Then, the paddles 20, 22 move from the positions as shown in FIG. 3 along the directions of the respective arrows A3, A4, the vertical components V3, V4 of the reactive forces R3, R4 push the boat body 1 forwards.

Figure 4:
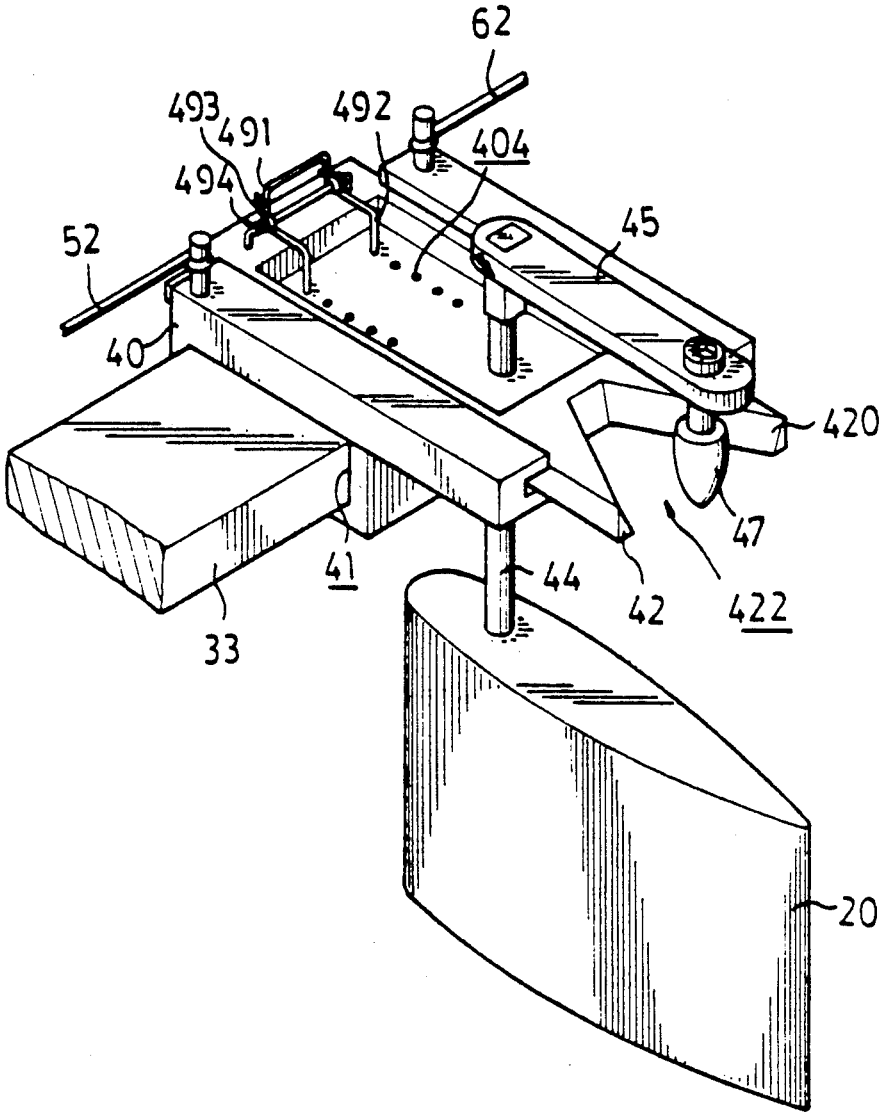
FIG. 4 is a perspective view of another embodiment of the restraining device.
Figure 5:
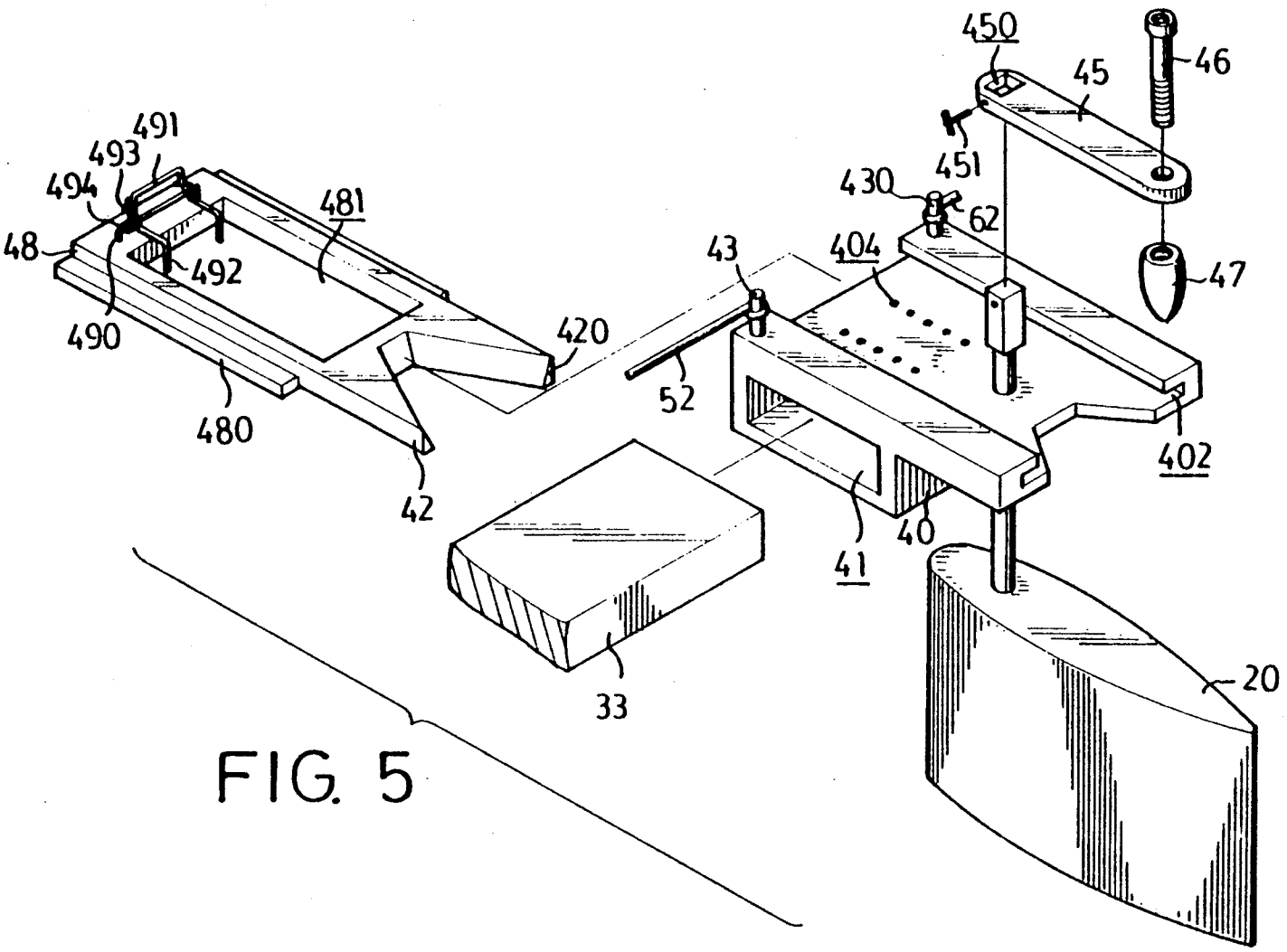
FIG. 5 is an exploded view of the restraining device of FIG. 4.

Referring next to FIGS. 4 and 5, illustrating another embodiment of the restraining device 4, in which similar parts are designated by similar reference numerals. The restraining device 4 is adjustable and comprises a sliding block 40 having a rectangular hole 41 for slidably receiving the bar 33. A pair of pins 43, 430 are fixed on both sides of the front end of the sliding block 40 and are fixed to the ends of the respective cables 52, 62. A pair of channel 402 are formed on the upper surface of the sliding block 40 and are perpendicular to the bar 33. A plurality pairs of holes 404 are formed on the upper surface of the sliding block 40. The shaft 44 is pivotally provided on the sliding block 40. The paddle 20 is fixed on the lower end of the shaft 44. The upper end of the shaft 44 is rectangular and engages with a rectangular hole 450 of the lever arm 45. A screw 451 fixed the shaft 44 and the lever arm 45 together. The stop 47 is disposed on the lower end of the bolt 46 which is disposed on the other end of the lever arm 45 opposite to the shaft 44.

A guide block 48 which is substantially a plate has an opening 481 formed in a center portion thereof. Two flanges 480 are formed on both sides of the guide block 48 and are slidably received in the channels 402 of the sliding block 40. The shaft 44 extends through the opening 481. The lugs 42, 420 are provided on the rear end of the guide block 48. An inverted U-shape support 490 is fixed on the front end of the guide block 48. A pawl 491 which has a substantially inverted N-shape is pivotally disposed on the support 490. The pawl 491 has two legs 492 and a hook 493. The legs 492 are located within the hole 481 of the guide block 48. A spring 494 is disposed on the support 490 and bears between the hook 493 and the guide block 48 so that the legs 492 of the pawl 491 are biased downward by the spring 494. The inner surfaces of the lugs 42, 420 form a substantially V-shaped notch 422. The legs 492 are engageable with either pair of the holes 404 so that the guide block 48 is selectively slidable relative to the sliding block 40 and so that the stop 47 is longitudinally movable relative to the notch 422. When the stop 47 moves forward relative to the notch 422, the rotatable range of the stop 47 and the paddle 20 is small. When the stop 47 moves rearward relative to the notch 422, the rotatable range of the stop 47 and the paddle 20 is large.

Figure 6:
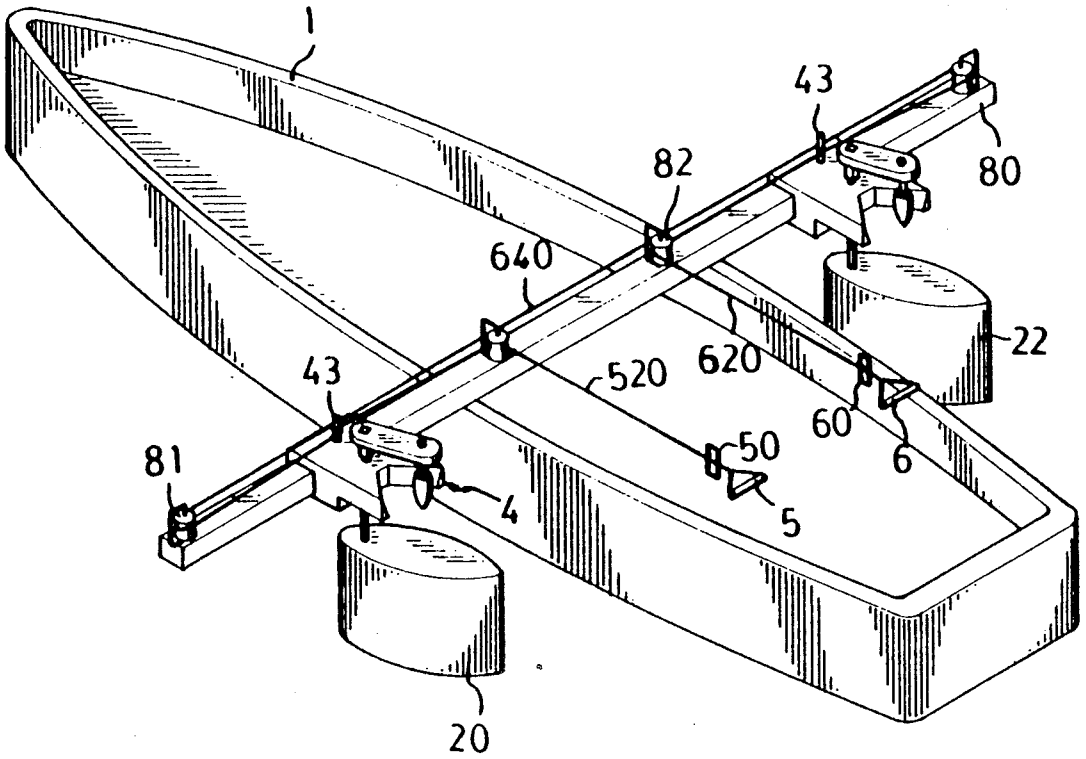
FIG. 6 is a perspective view of another embodiment of the propulsion mechanism for a boat in accordance with the present invention.

Referring next to FIG. 6, illustrating another embodiment of the propulsion mechanism in accordance with the present invention. Instead of the frame body 3 of FIG. 1, a beam 80 with four pulleys 81, 82 is laterally provided on the boat body 1 and extends beyond both sides of the boat body 1. Two restraining devices 4 which have a configuration substantially similar to that of the restraining devices 4 shown in FIG. 1 are slidably provided on the ends of the beam 80. A cable 520, 620 is fixed between the pulling ring 5, 6 and a respective pin 43 of the restraining devices 4. A middle portion of the cables 520, 620 passes the respective pulley 82 in slidable relationship. A cable 640 passes the pulleys 81 and has the ends fixed to the pins 43 so that the restraining devices 4 move in concert.

When the user expends energy by alternatively and reciprocally pulling the pulling rings 5, 6, the restraining devices 4 are drawn to slide along the beam 80 so that a relative movement between the paddles 20, 22 and the water makes a reactive force to propel the boat body 1 forward.

It is to be noted that the lever arm 45 and the shaft 44 are detachable so that the paddle 20, 22 can be rotated for 180 degrees and the stop 47 is located within the notch 422 of the restraining device 4. The reactive forces applied to the paddles 20, 22 push the boat body 1 rearwards along a direction opposite to the arrow F (FIG. 1 or FIG. 6).

Accordingly, the present invention provides a different configuration of the propulsion mechanism for the boat, which greatly increases the exercising and entertainment effects. The present invention is also suitable for competition.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A propulsion mechanism for a boat comprising:

a boat body;

a frame body being disposed on a rear end of said boat body, said frame body including a bar which is lateral to said boat body;

a plurality of pulleys being substantially disposed on both sides of said frame body;

a sliding block being provided on and slidable along said bar;

a shaft being pivotally and vertically disposed on said sliding block;

a paddle being disposed on a lower end of said shaft and being substantially submerged in water on which said boat body is floated;

a restraining device being coupled to an upper end of said shaft so that said restraining device and said paddle rotate in concert, said restraining device limiting a rotatable range of said paddle;

a cable being provided and surrounding said pulleys, said sliding block being fixed to a middle portion of said cable;

two pulling rings being fixed to two free ends of said cable; and said sliding block being drawn to move laterally and reciprocally when said pulling rings are alternatively and reciprocally pulled by a user, so that said paddle moves relative to said water and so that a reactive force is produced to propel said boat body.

2. A propulsion mechanism according to claim 1, wherein said restraining device includes a lever arm, one end of said lever arm being fixed to said upper end of said shaft, said lever arm being perpendicular to said shaft; a bolt being vertically and threadedly engaged on an other end of said lever arm; a stop being fixed on a lower end of said bolt; and a notch being formed on a rear end of said sliding block, said stop being located within said notch, and a rotatable movement of said stop and said paddle being limited by said notch.

3. A propulsion mechanism according to claim 2, wherein said upper end of said shaft has a substantially rectangular cross section, and a corresponding rectangular hole is formed in said one end of said lever arm for engagement with said upper end of said shaft.

4. A propulsion mechanism according to claim 1, wherein a pin is vertically disposed on said sliding block, and said pin is fixed to said middle portion of said cable.

5. A propulsion mechanism according to claim 1, wherein said bar has a substantially rectangular cross section, a rectangular hole is formed on a front end of said sliding block, said bar is slidably received in said rectangular hole so that said sliding block is slidable along said bar.

6. A propulsion mechanism according to claim 1, wherein a pair of channels are formed on both sides of an upper surface of said sliding block, said channels are perpendicular to said bar; a guide block is slidably received in said channels; an opening is formed in a center portion of said guide block; said shaft is pivotally provided on said sliding block and extends through said opening; a plurality of pairs of holes are formed on a middle portion of said upper surface of said sliding block; a support is fixed on a front end of said guide block; a pawl which has two legs is pivotally disposed on said guide block, said legs extend through said opening; a hook is formed on an upper portion of said pawl; a spring bears between said hook and said guide block so that said legs of said pawl are engageable with either pair of said holes and so that said guide block is adjustable relative to said sliding block; a notch is formed on a rear end of said guide block, said notch is V-shaped; said restraining device includes a lever arm, one end of said lever arm being fixed to said upper end of said shaft, said lever arm being perpendicular to said shaft, a bolt being vertically and threadedly engaged on an other end of said lever arm, a stop being fixed on a lower end of said bolt, said stop being located within said notch; a rotatable movement of said stop and said paddle is limited by said notch; and said stop is longitudinally slidable relative to said notch so that said rotatable range of said paddle is adjustable.

7. A propulsion mechanism for a boat comprising:

a boat body;

a beam being laterally provided on said boat body;

two first pulleys being disposed on both ends of said beam;

two second pulleys being disposed on a middle portion of said beam;

a pair of sliding blocks being provided on and slidable along said beam;

a shaft being pivotally and vertically disposed on each of said sliding blocks;

a paddle being disposed on a lower end of each said shaft and being substantially submerged in water on which said boat body is floated;

a restraining device being coupled to an upper end of each said shaft so that said restraining device and said paddle rotate in concert, said restraining device limiting a rotatable range of said paddle;

a first cable being provided and surrounding said first pulleys and two ends of said first cable being fixed to said sliding blocks;

two second cables, one end of each second cable being fixed to a respective sliding block, each second cable surrounding a respective second pulley;

two pulling rings being fixed to free ends of said second cables; and said sliding blocks being drawn to move laterally and reciprocally when said pulling rings are alternatively and reciprocally pulled by a user, so that said paddles move relative to said water and so that a reactive force is produced to propel said boat body.

* * * * *